US005383587A

United States Patent [19]

Carpenter

[11] Patent Number: 5,383,587

[45] Date of Patent: Jan. 24, 1995

[54] DEVICE FOR CARRYING ELONGATED SKI EQUIPMENT

[76] Inventor: Gary L. Carpenter, 7160 Suntide Pl., Colorado Springs, Colo. 80919

[21] Appl. No.: 90,328

[22] Filed: Jul. 12, 1993

[51] Int. Cl.[6] ..... A45F 3/14

[52] U.S. Cl. ..... 224/257; 224/917; 224/200; 224/202

[58] Field of Search ..... 224/257, 917, 200, 913, 224/258, 264, 202, 203, 205

[56] References Cited

U.S. PATENT DOCUMENTS

| | | | |
|---|---|---|---|
| 2,576,559 | 11/1951 | Bennek | 224/913 |
| 3,035,746 | 5/1962 | Hayes | 224/913 |
| 4,114,838 | 9/1978 | Knauf . | |
| 4,456,284 | 6/1984 | Saka . | |
| 4,658,999 | 4/1987 | Hilty | 224/917 |
| 4,729,591 | 3/1988 | Scalise | 224/917 |
| 4,903,875 | 2/1990 | Smart et al. | 224/917 |
| 5,104,017 | 4/1992 | Vandagriff | 224/917 |
| 5,107,995 | 4/1992 | Simpson | 224/917 |

FOREIGN PATENT DOCUMENTS

| | | | |
|---|---|---|---|
| 300971A | 1/1989 | European Pat. Off. | 224/917 |
| WO/90/079-60 | 7/1990 | WIPO | 224/917 |

*Primary Examiner*—Henry J. Recla
*Assistant Examiner*—David J. Walczak
*Attorney, Agent, or Firm*—Holland & Hart; William J. Kubida; John B. Phillips

[57] ABSTRACT

A device for carrying elongated ski equipment in which two ends of an elongated flexible strap are attached to form a closed loop having an outer pocket at a bottom end thereof. The outer pocket is adapted to receive one end of the elongated ski equipment. A stabilizing tie strap attached adjacent a top end of the closed loop is adapted to secure the elongated ski equipment to the closed loop. The outer pocket and the tie strap are attached to the elongated ski equipment on opposite sides of a center of gravity of the elongate ski equipment so that the center of gravity of the elongated ski equipment remains substantially below the level of a person's shoulder when the closed loop is suspended from the person's shoulder.

33 Claims, 6 Drawing Sheets

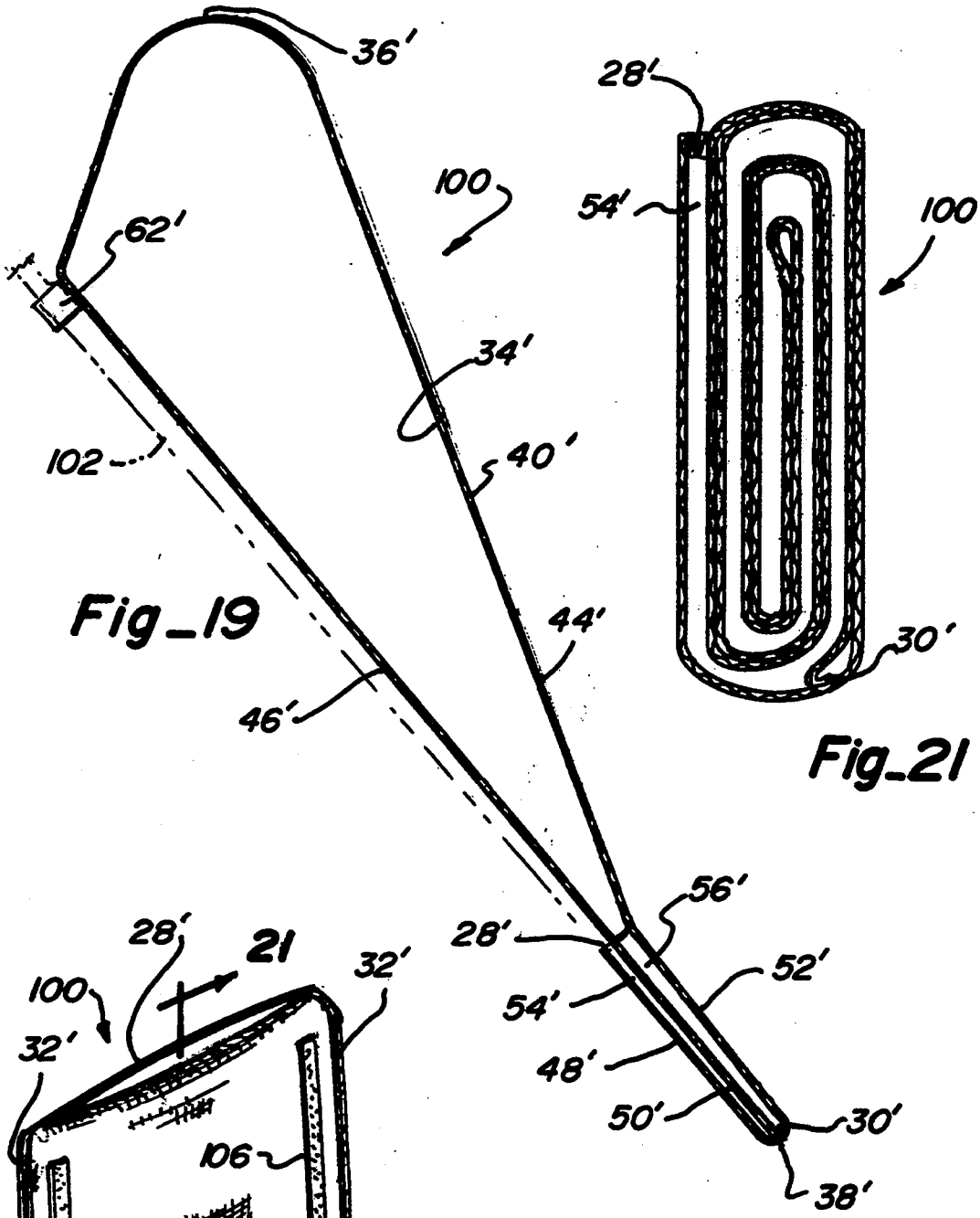
Fig_19
Fig_21
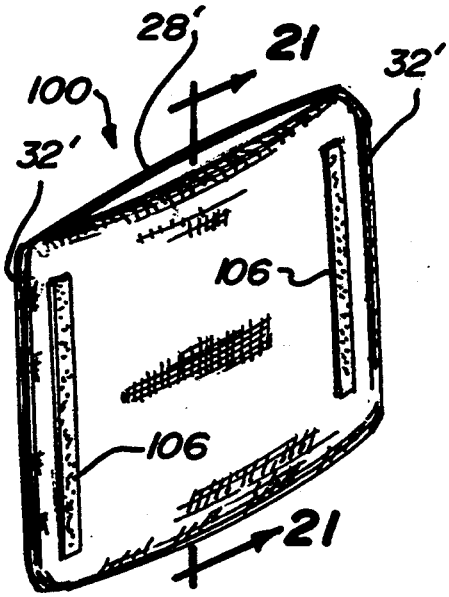
Fig_20
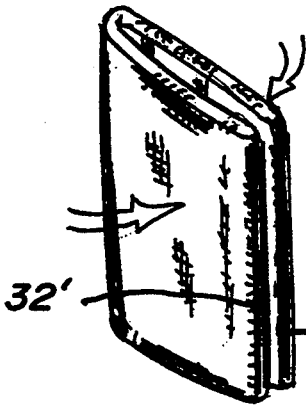
Fig_22

DEVICE FOR CARRYING ELONGATED SKI EQUIPMENT

FIELD OF THE INVENTION

This invention pertains to the sports of skiing and snowboarding, and more particularly, to a new and improved device for carrying elongated ski equipment such as Nordic or Alpine skis and ski poles, as well as snowboards and the like.

BACKGROUND OF THE INVENTION

Skiers are frequently required to carry their skis and poles over great distances in order to reach a desired ski area. For example, it is not uncommon for skiers to walk hundreds of yards from a parking lot or a bus stop to a base lift at a ski resort. Even after reaching the ski slopes, some skiers may wish to ski areas not serviced by ski lifts. In that case, the skiers must hike to the desired location while carrying their skis and poles. However, carrying a pair of skis is often cumbersome and tiring due to the great weight and long length of a typical pair of skis. This difficulty is only compounded when a skier must carry both a pair of skis and a set of ski poles or more than one pair of skis (e.g., a child's pair of skis in addition to their own).

Skiers typically carry a pair of skis by holding one end of the ski pair with one hand while balancing the bulk of the skis on one shoulder. The other hand is typically used to hold the ski poles and possibly a pair of ski boots or other equipment. A skier may quickly become fatigued when carrying skis in this manner, particularly when walking long distances. Additionally, carrying skis on a shoulder can be hazardous in crowded or confined areas due to the possibility of accidentally striking the head of another. Furthermore, when carrying a pair of skis and poles in this manner, a skier does not have a free hand with which to carry other items or to grasp a railing while traversing stairs. Having both hands occupied, while maintaining the center of gravity of the heavy skis at shoulder level, increases the chances for a serious slip and fall accident, particularly when walking through snow or on wet or icy surfaces.

These problems have been addressed, to a limited extent, by prior art ski bags which are large enough to hold both a pair of skis and a pair of ski poles. However, a bag of this size is too large to be stored on a skier's person, and thus must be temporarily stored while skiing. If a skier is unable or unwilling to store the ski bag, the bag cannot be used to carry the skis and poles to the ski lifts. Furthermore, since it cannot be stored on a skier's person, a ski bag of this size cannot be used on the slopes to carry skis and poles between ski runs.

A number of known ski-carrying devices have attempted to alleviate the problems inherent with carrying skis and poles. However, these devices suffer from one or more disadvantages which currently preclude their acceptance by skiers. For example, some ski carriers do not allow for the simultaneous carriage of both skis and ski poles, thereby requiring the skier to carry the ski poles in a free hand. Alternatively, some ski carriers require the poles to be used as an integral part of the ski-carrying device, thereby requiring the skier to carry the poles even if the skier does not want to use the poles while skiing.

Some known ski carriers utilize a single adjustable strap attached to a pair of skis forward and rearward of the ski bindings. Once secured to the skis, the strap may be suspended from a skier's shoulder while the skis rest against the skier's back. However, suspended in this manner, the ski bindings tend to press against the skier's back causing great discomfort while carrying the skis. Some known devices have attempted to alleviate this problem by holding the skis so that the edges rather than the bindings of the skis are maintained against the skier's back. However, by supporting the skis only along their narrow edges, the skis are more easily destabilized during transport and are more likely to slip off a skier's shoulder. Furthermore, the sharp edges of the skis may injure a skier or damage a skier's outer garment.

It is typical for current ski-carrying straps that fits all sizes of skis to include complex and bulky adjustment and fastening means to adjust the length of the strap and attach the strap to the skis. These features are expensive to manufacture and frequently make the current ski-carrying straps difficult to use, particularly in cold weather or when wearing ski gloves. Furthermore, while some known ski-carrying devices purport to be compactable so that they may be carried on a skier's person, they are typically too bulky to be comfortably carried while skiing. Additionally, the inclusion of features such as metal or plastic fasteners and adjustment means can make carrying these devices hazardous since falling on top of such hardware while skiing may injure the skier.

Thus, due to their various disadvantages, known ski-carrying devices are seldom used. Rather than pay the high price associated with these complex and uncomfortable ski carriers, skiers typically choose to carry their skis and poles by hand substantially as described above.

The difficulties associated with carrying skis over long distances are equally applicable to snowboarders who must similarly carry their snowboards either to the lifts or up the slopes when snowboarding in areas not serviced by lifts. Although snowboarders do not use ski poles, snowboards are typically more burdensome to carry than a pair of skis due to the greater bulk of a snowboard. Presently, there are no known snowboard carriers other than large bags within which an entire snowboard may be stored.

It is with regard to this background information that the improvements available from the present invention have evolved.

SUMMARY OF THE INVENTION

It is an object of the present invention to provide an improved carrying device for transporting elongated ski equipment in a hands-free manner, where the elongated ski equipment comprises a snowboard as well as a ski or a pair of skis.

It is a further object of the present invention to provide an improved carrying device for elongated ski equipment which is durable but which is also comfortable to use.

It is a still further object of the present invention to provide an improved carrying device for elongated ski equipment which may be easily stored on a person when not in use.

It is a still further object of the present invention to provide an improved carrying device for elongated ski equipment that allows for carriage of elongated auxiliary ski equipment such as a ski pole when the elongated ski equipment comprises a ski.

The foregoing objects are achieved in the present invention wherein two ends of an elongated flexible strap are attached to form a closed loop having an overlapping outer pocket at a bottom end thereof. The outer pocket is adapted to receive one end of the elongated ski equipment. Additionally, a stabilizing tie strap attached adjacent a top end of the closed loop is adapted to secure the elongated ski equipment to the closed loop. By locating the outer pocket and the tie strap at substantially opposite ends of the closed loop, a center of gravity of the elongated ski equipment is maintained between the outer pocket and the tie strap when the closed loop is suspended from a person's shoulder. In this manner, the elongated ski equipment may be comfortably carried in a variety of orientations since the center of gravity remains substantially below the person's shoulder.

The comfort and durability of the carrying device may be further enhanced by forming the entire carrying device from a waterproof fabric material. Additionally, an all-fabric construction would allow the carrying device to be tightly compacted and thus easily stored in a pocket when not in use. The closed loop may also carry elongated auxiliary ski equipment by adding a support member to hold one end of the auxiliary ski equipment adjacent the bottom end of the closed loop and a second tie strap adjacent the top end of the closed loop to secure the other end of the auxiliary ski equipment.

A more complete appreciation of the present invention and its scope can be obtained from understanding the accompanying drawings, which are briefly summarized below, the following Detailed Description of Preferred Embodiments of the invention, and the appended claims.

BRIEF DESCRIPTION OF THE DRAWINGS

FIG. 19 is an enlarged section view of the snowboard sling taken substantially in the plane of line 19—19 of FIG. 18, with a snowboard shown in phantom.

FIG. 20 is a perspective view of the snowboard sling in a stored configuration.

FIG. 21 is an enlarged section view taken substantially in the plane of line 21—21 of FIG. 20.

FIG. 22 is a perspective view of the snowboard sling illustrated in FIG. 20, showing the snowboard sling in a more compact stored configuration.

DETAILED DESCRIPTION OF PREFERRED EMBODIMENTS

Figure 1:
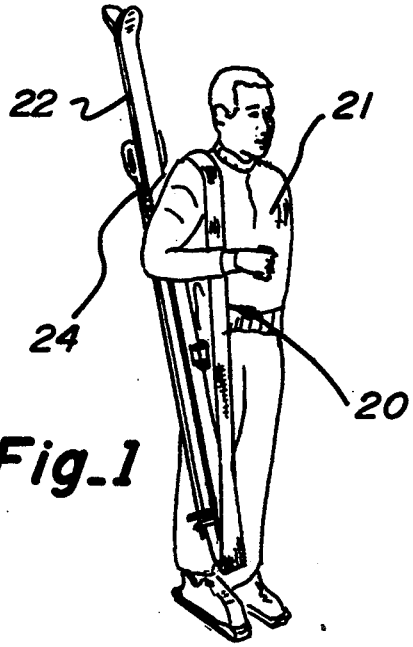
FIG. 1 is a perspective view of a skier utilizing a ski sling embodying the present invention to suspend a pair of skis and a pair of ski poles from his shoulder.
Figure 2:
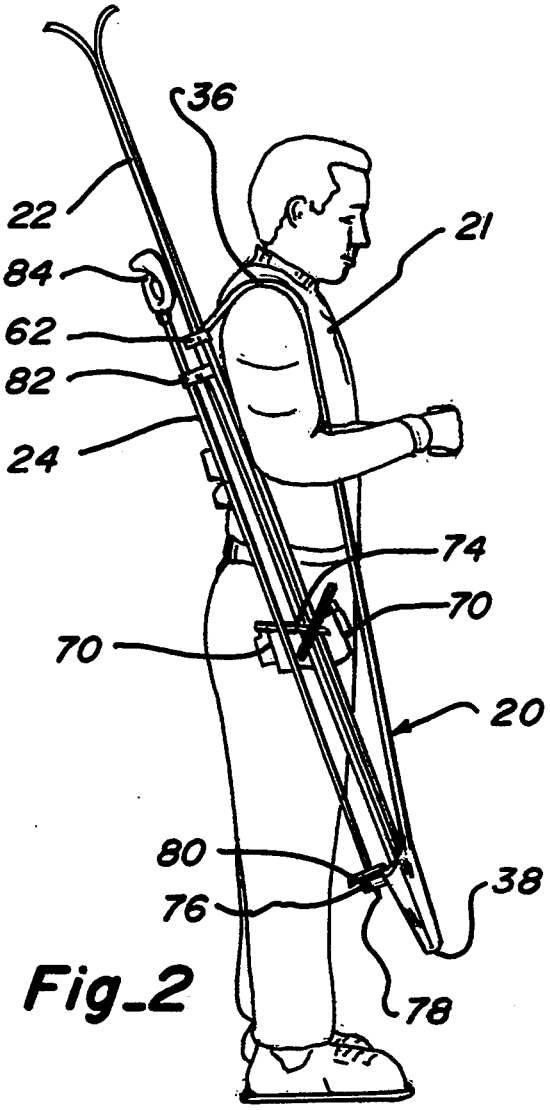
FIG. 2 is an enlarged side view of the skier and the ski sling illustrated in FIG. 1.
Figure 3:
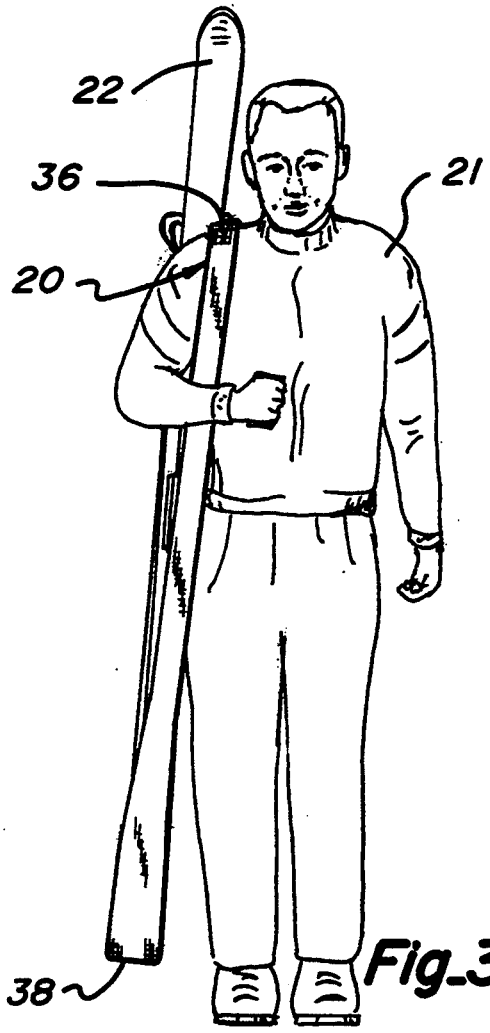
FIG. 3 is an enlarged front view of the skier and the ski sling illustrated in FIG. 1.

Referring to FIGS. 1–3, a ski sling 20 according to one embodiment of the present invention is shown. FIGS. 1–3 illustrate a skier 21, from three different perspectives, utilizing a ski sling 20 to suspend a pair of skis 22 and ski poles 24 from his shoulder without the use of his hands.

The ski sling 20 comprises a single fabric strap having a first end 28, a second end 30 and opposing side edges 32. The opposing side edges 32 are substantially parallel to one another, and the perpendicular distance between the side edges 32 defines a width dimension of the strap. The fabric strap is folded over upon itself so that the first end 28 overlaps the second end 30 and forms a closed loop 34 as shown in FIGS. 5 and 6.

Figure 5:
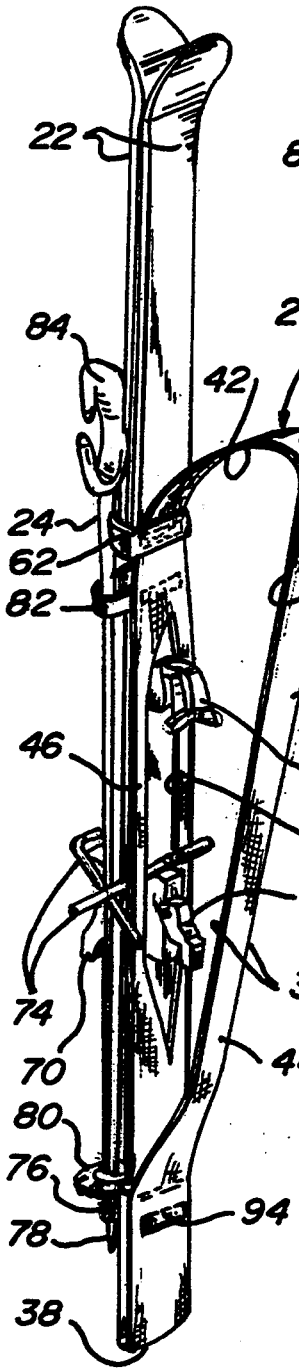
FIG. 5 is a perspective view of a pair of skis and a pair of ski poles secured to the ski sling embodying the present invention.
Figure 6:
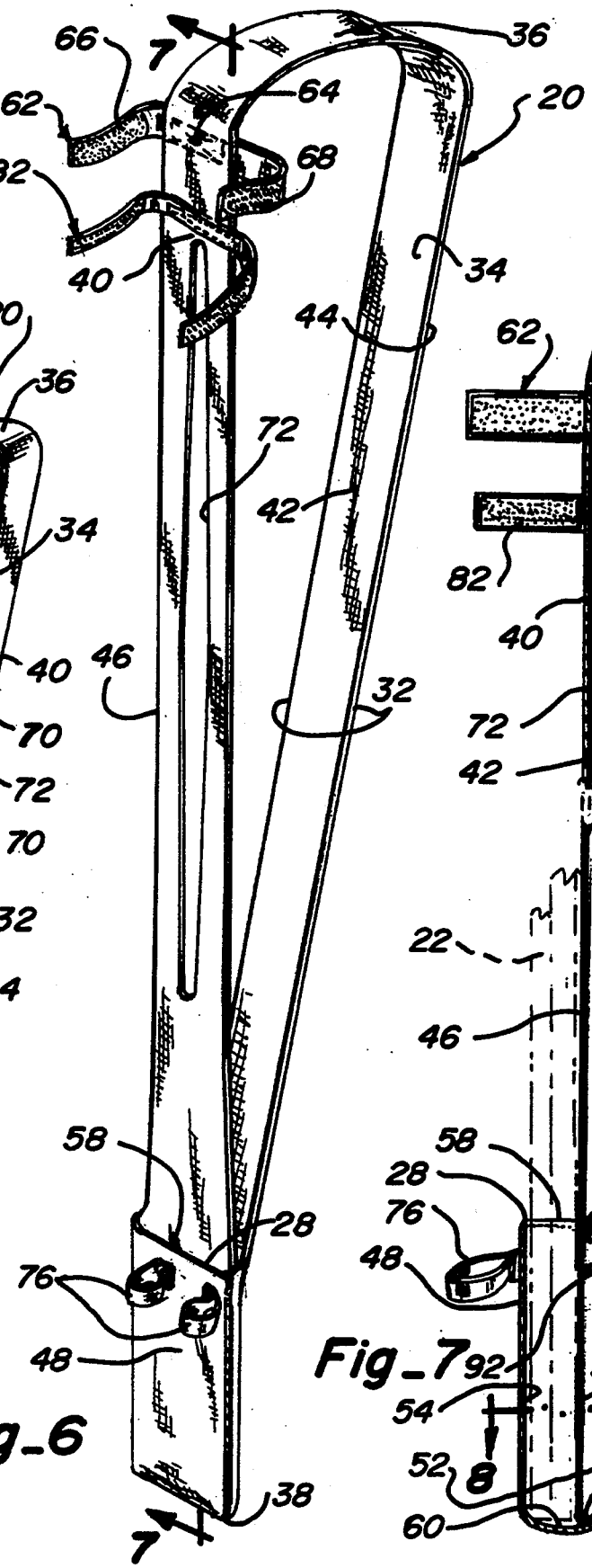
FIG. 6 is an enlarged perspective view of the ski sling embodying the present invention.
Figure 7:
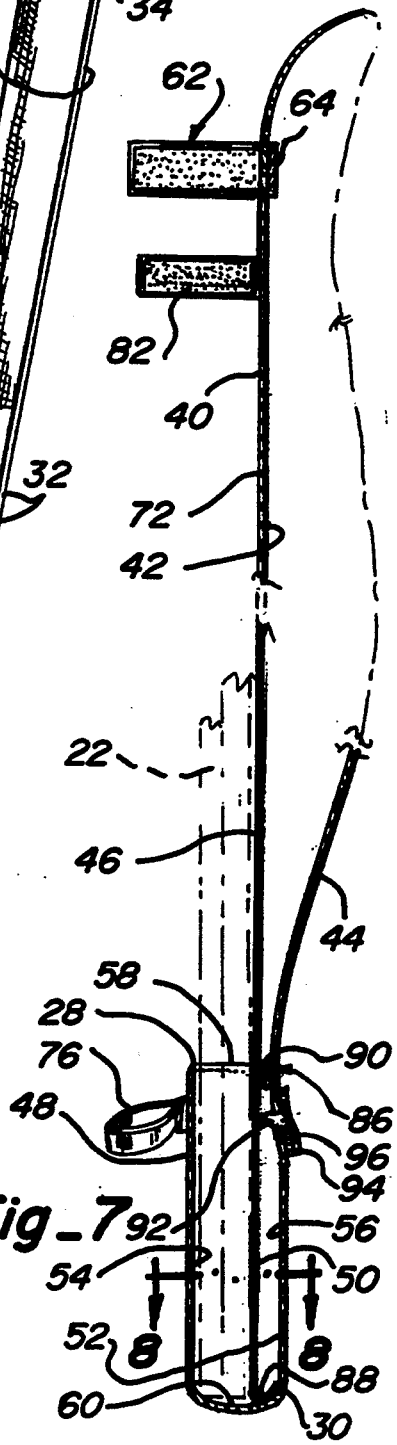
FIG. 7 is a section view of the ski sling taken substantially in the plane of line 7—7 of FIG. 6, with a portion broken out and with a portion of a pair of skis shown in phantom to illustrate details of an outer pocket and an inner pocket.

The closed loop 34 has a top end 36 and a bottom end 38 as shown in FIGS. 5 and 6. The distance between the top and bottom ends 36 and 38 defines a length dimension of the closed loop 34. Additionally, the circumference of the closed loop 34 defines an exterior surface 40 and an interior surface 42 as shown in FIGS. 5–7. The closed loop 34 also has a front side 44 and a rear side 46 which extend along the length of the closed loop 34, as shown in FIGS. 5–7.

Figure 8:
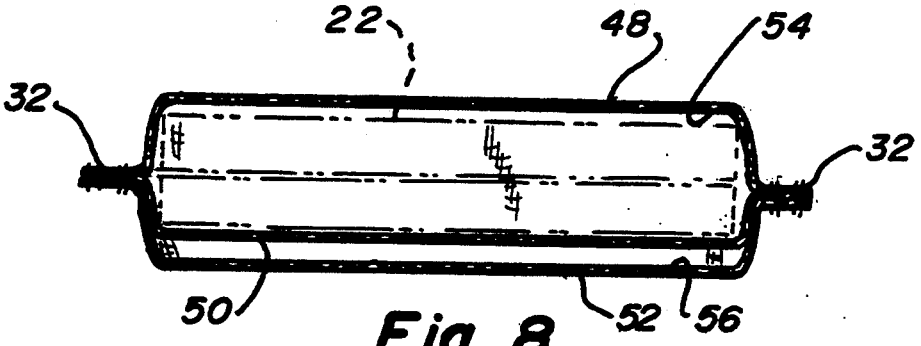
FIG. 8 is an enlarged section view taken substantially in the plane of line 8—8 of FIG. 7, with a pair of skis shown in phantom in the outer pocket, illustrating the attachment of the side edges of the single strap that forms the closed-loop ski sling.

A first segment 48 of the fabric strap adjacent the first end 28 overlaps both a second segment 50 of the strap adjacent the second end 30 and a third segment 52 of the strap on the front side 44 of the closed loop 34, as shown in FIG. 7. The first segment 48, the second segment 50 and the third segment 52 of the strap are all preferably sewn together along their respective side edges 32, as shown in FIG. 8. Attached in this manner, the first, second and third segments effectively form an outer pocket 54 and an inner pocket 56 adjacent the bottom end 38 of the closed loop 34, as shown in FIGS. 6–8.

The outer pocket 54 is formed between the first segment 48 and the second segment 50 of the fabric strap. The inner pocket 56 is formed between the second and third segments 50 and 52, respectively, of the fabric strap. Thus, the second segment 50 of the strap separates the outer and inner pockets 54 and 56, as shown in FIGS. 7 and 8.

The outer pocket 54 includes an open top end 58 and a closed bottom end 60 and is positioned on the rear side 46 of the closed loop 34 to receive the heel ends of the pair of skis 22, as shown in FIGS. 6 and 7. The outer pocket 54 is wider than the top end 36 of the closed loop 34 and has an orifice of sufficient size to accommodate either Nordic or Alpine skis.

A stabilizing elongated tie strap 62 is attached to the rear side 46 of the closed loop 34 adjacent the top end 36 of the loop. The tie strap 62 is preferably formed from the same material as the closed loop 34. A middle portion 64 of the tie strap 62 is preferably sewn to the interior surface 42 of the closed loop 34 between the side edges as shown in FIG. 6. First and second end portions 66 and 68 of the elongated tie strap 62 extend on either side of the attached middle portion 64, each end portion containing a hook and loop fastener (such as Velcro ®) on a side opposite the other end portion. The two end portions 66 and 68 of the tie strap 62 are thus adapted to be wrapped around and securely fastened to the pair of skis 22 at a point above the ski binding 70, thereby securing the pair of skis 22 to the exterior surface 40 of the rear side 46 of the closed loop 34, as shown in FIG. 5.

An elongated opening 72 on the rear side 46 of the closed fabric loop 34 extends from a predetermined point above the open top end 58 of the outer pocket 54 to a predetermined point below the elongated tie strap 62, as shown in FIGS. 5–7. The aperture of the elongated opening 72 is adapted to receive the ski binding 70 on the ski 22 which contacts the rear side 46 of the closed loop 34. In this manner, the flat top surface of the ski 22 will engage the exterior surface 40 of the rear side 46 of the closed loop, as shown in FIGS. 1–5.

Prior to loading the pair of skis 22 into the ski sling 20, the skis 22 are coupled together along their bases by interlocking the ski brakes 74. The heel ends of the skis 22 are then inserted into the outer pocket 54. Next, the ski binding 70 on the ski 22 facing the rear side 46 of the closed loop 34 is fit within the elongated opening 72. The first and second ends 66 and 68 of the stabilizing elongated tie strap 62 are then wrapped about the skis 22 and secured to one another at a point above the ski binding 70, as shown in FIG. 5. Once the skis 22 are attached to the ski sling 20 in his manner, the skier's arm is extended through the closed loop 34, and the interior surface 42 of the closed loop 34 is fit over the skier's shoulder.

The attachment of the elongated tie strap 62 at a point above the binding 70 positions the center of gravity of the skis 22, which is typically located near the toe portion of the ski binding 70, between the tie strap 62 and the outer pocket 54. In this manner, the center of gravity of the skis is always at a level below the level of the skier's shoulder, as shown in FIGS. 1–4. Furthermore, when the top end 36 of the closed-loop ski sling 20 is fit over the skier's shoulder, the center of gravity of the skis is suspended substantially directly below the skier's shoulder, as shown in FIGS. 1–3.

Figure 4:
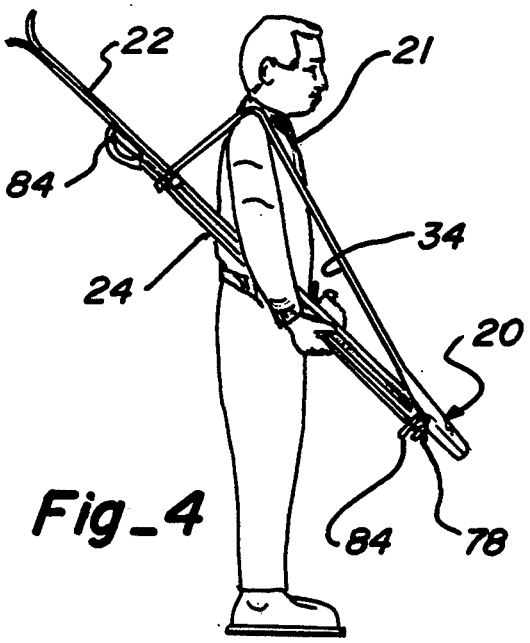
FIG. 4 is a side view of the skier and the ski sling illustrated in FIG. 1, showing the ski sling in a different orientation from that illustrated in FIG. 1.

Maintaining the center of gravity of the skis 22 substantially directly below the skier's shoulder allows the skier 21 to carry the pair of skis 22 in a hands-free manner without providing any extra support to the ski sling 20, as shown in FIGS. 1–3. Should the skier 21 wish to adjust the orientation of the skis 22, such as when climbing steep terrain or walking under low overheads, the closed loop 34 may be easily slid along the skier's shoulder to alter the orientation of the skis 22. FIG. 4 illustrates one example of an altered orientation where the skis 22 have been rotated closer to a horizontal position and the center of gravity has been moved slightly forward of the skier's shoulder. The forward center of gravity causes a rotational moment which would tend to rotate the skis 22 and the ski sling 20 back to the orientation shown in FIGS. 1–3. Thus, to maintain the skis 22 in the orientation shown in FIG. 4, the skier 21 must use a free hand to support the skis and thereby counter the rotational moment.

The ski sling 20 also preferably includes two fabric loops 76 attached to the exterior of the outer pocket 54 adjacent the first end 28 of the strap, as shown in FIGS. 5–7, 9 and 10. The fabric loops 76 are preferably formed from the same material as the closed loop 34 and are preferably sewn to the outer pocket 54 adjacent the opposing side edges 32, as shown in FIG. 6. Each fabric loop 76 is adapted to receive a tip 78 of one ski pole 24 which extends below a basket 80 at one end of the ski pole, as shown in FIG. 5. A stabilizing elongated ski pole strap 82 is attached to the exterior surface of the rear side 46 of the closed loop 34 between the tie strap 62 and the elongated opening 72, as shown in FIGS. 5–7. The ends of the ski pole strap 82 include hook and loop fasteners, similar to the elongated tie strap 62, and are adapted to be securely wrapped about both the pair of skis 22 and the ski poles 24 at a point below the ski pole handles 84, as shown in FIGS. 2 and 5.

The fabric loops 76 and the ski pole strap 82 offer the skier 21 the option of carrying the poles 24 with the skis 22. However, unlike some prior art ski carriers, the poles 24 are not an integral part of the ski sling 20 and thus the skier 21 is not required to carry the poles 24 in order to also carry the skis 22. Once the skis 22 are attached to the ski sling 20, the skier 21 may attach the poles 24 to the ski sling 20 by first inserting the ski pole tips 78 through the fabric loops 76 so that the ski pole baskets 80 contact the loops 76. The ski pole strap 82 is then secured about the ski poles 24 to hold the poles in a close, substantially parallel relationship to the skis 22, while the weight of the ski poles 24 prevents the ski pole tips 78 from withdrawing from the fabric loops 76. Since the ski pole strap 82 necessarily extends around both the pair of skis 22 and the ski poles 24, the ski pole strap 82 also acts as a backup tie strap in case of the unlikely failure of the primary tie strap 62.

The inner pocket 56 has an open top end 86 and a closed bottom end 88, and is preferably adapted to hold small accessory items such as money, credit cards, identification, or car keys. The open top end 86 of the inner pocket 56 is preferably sealed by a hook and loop fastener 90, as shown in FIG. 7. A horizontal opening 92 is also preferably formed in the fabric on the front side 44 of the closed loop 34 at a point slightly below the open top end 86 of the inner pocket 56. The horizontal opening 92 extends between the opposing side edges 32 and is large enough to allow access to the inner pocket 56. An elongated fabric flap 94 is preferably sewn to the front side 44 of the closed loop 34 above the opening 92, and is positioned to cover the entire opening 92 as shown in FIGS. 5, 7, 9 and 10. A hook and loop fastener 96 preferably secures the fabric flap 94 over the opening 92 to prevent the accidental loss of the accessory items contained within the inner pocket 56.

The top and bottom ends 36 and 38, respectively, of the closed loop 34 are inherent high-stress points since these ends support the weight of the skis 22 and ski poles 24. However, the ski sling 20 is constructed so that no stitched seams are located at either of these ends. Thus, the lightweight, all-fabric sling 20 is capable of carrying large, heavy skis without failure. Two additional areas that encounter high stress concentrations are located at the points where the elongated tie strap 62 and the ski pole strap 82 are attached to the rear side 46 of the closed loop 34. To prevent a failure at these two stress points, the two straps 62 and 82 are preferably attached with reinforced stitching for extra security.

Since the length of the closed loop 34 is not adjustable, the ski sling 20 is preferably manufactured in three different lengths to accommodate different length skis. The size and position of the elongated opening 72 are predetermined for each different ski sling length so that the elongated opening 72 will fit around the ski bindings 70 of a given range of ski lengths.

Figure 9:
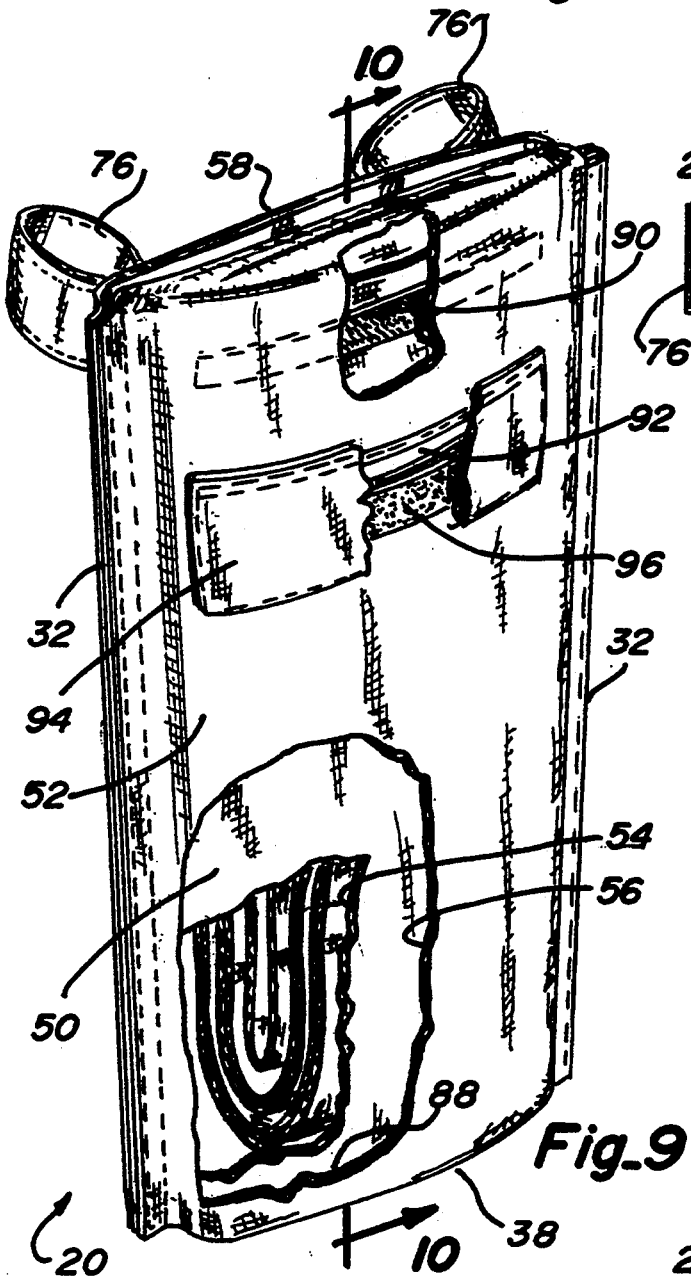
FIG. 9 is a perspective view of the ski sling in a stored configuration, with portions broken out to illustrate the inner pocket and means for gaining access to the inner pocket.
Figure 10:
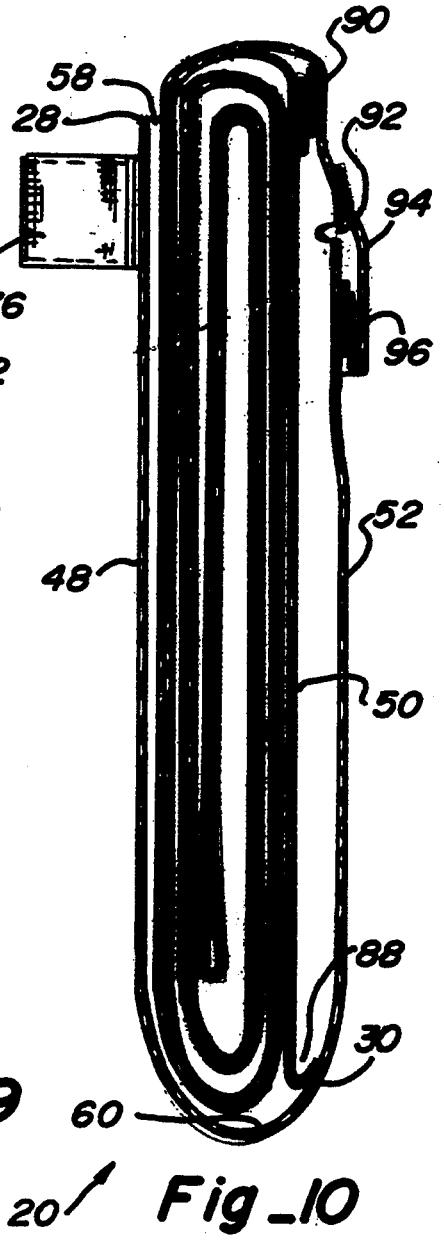
FIG. 10 is a section view taken substantially in the plane of line 10—10 of FIG. 9.

When not being used to carry skis 22, a majority of the closed loop 34 can be folded up and stored within the outer pocket 54, as shown in FIGS. 9 and 10. Thus, in the stored configuration, the ski sling 20 is converted into a compact, substantially flat pliable package that may be easily stored within a coat pocket while skiing. When the ski sling 20 is stored in this manner, the contents the inner pocket 56 may still be accessed via the opening 92, as shown in FIGS. 9 and 10.

Figure 11:
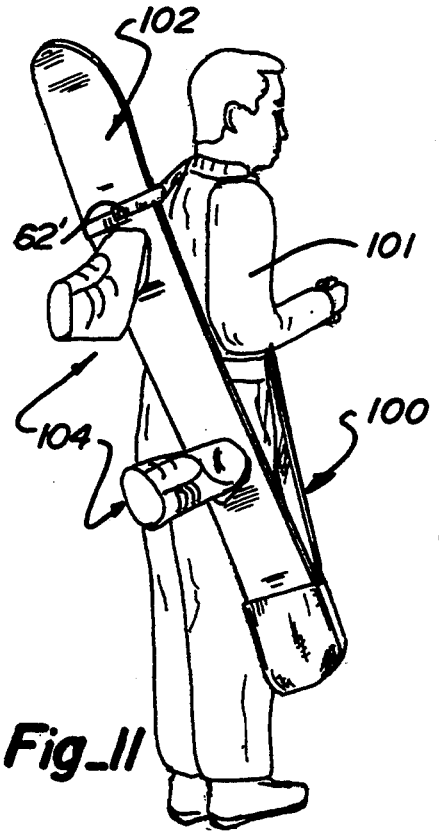
FIG. 11 is a perspective view of a snowboarder utilizing a snowboard sling embodying the present invention to support a snowboard along his back.
Figure 12:
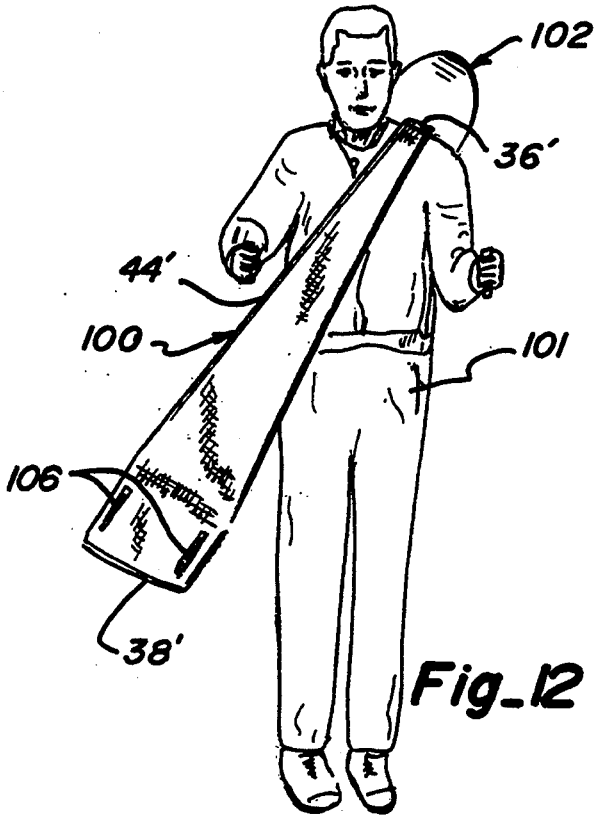
FIG. 12 is a front view of the snowboarder and the snowboard sling illustrated in FIG. 11.
Figure 13:
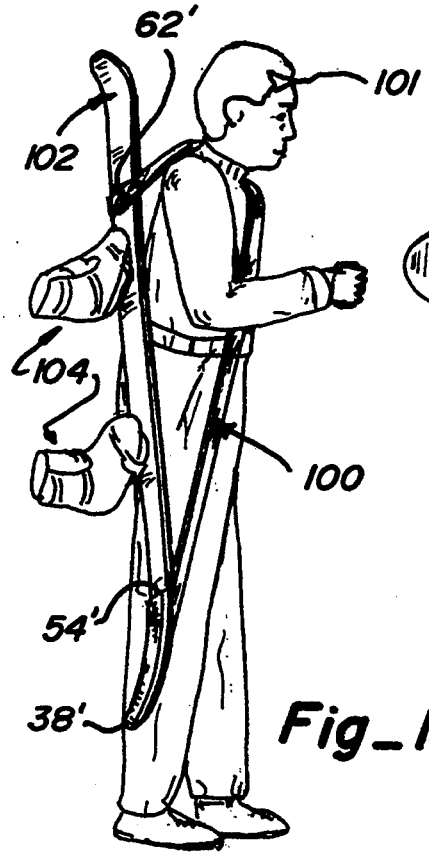
FIG. 13 is a side view of the snowboarder and the snowboard sling illustrated in FIG. 11.
Figure 14:
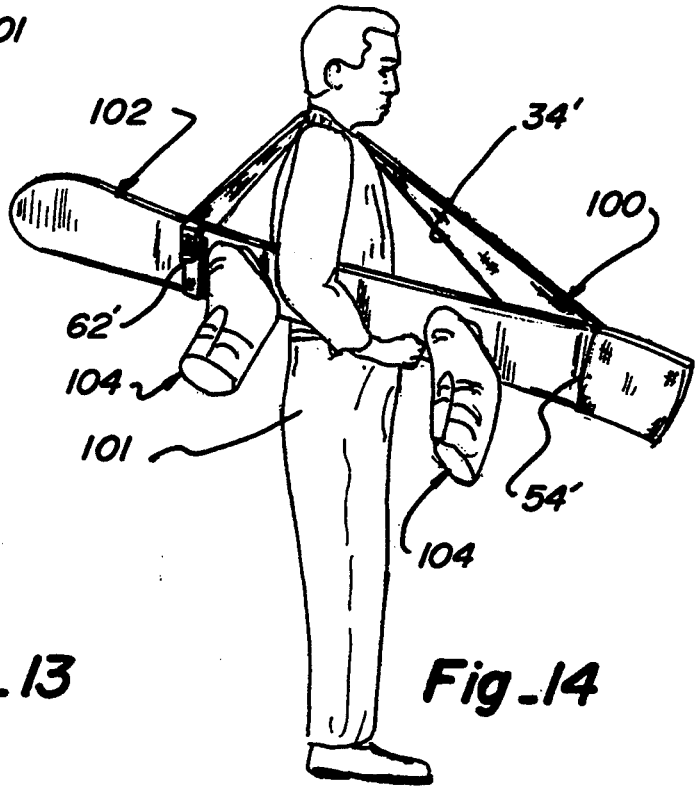
FIG. 14 is a side view of the snowboarder and the snowboard sling illustrated in FIG. 11, showing the snowboard sling in a different orientation from that illustrated in FIG. 11.
Figure 16:
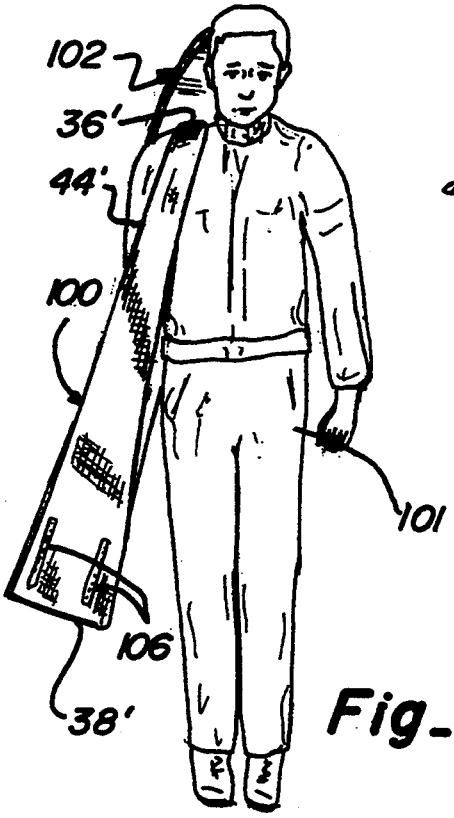
FIG. 16 is a front view of the snowboarder and the snowboard sling illustrated in FIG. 15.
Figure 17:
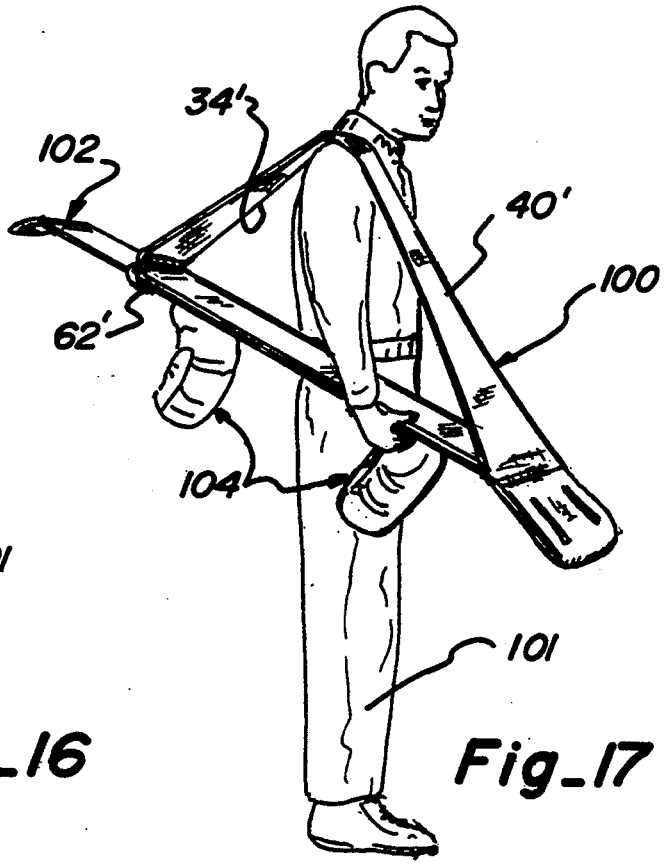
FIG. 17 is a side view of the snowboarder and the snowboard sling illustrated in FIG. 15.
Figure 15:
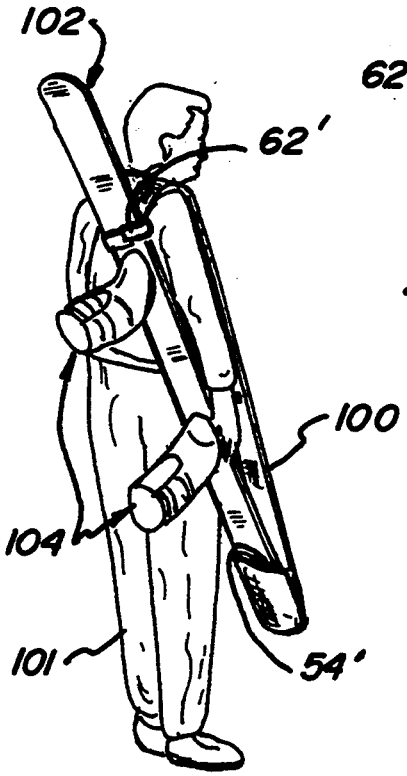
FIG. 15 is a perspective view of a snowboarder utilizing a snowboard sling embodying the present invention to support a snowboard along one side of his body.

Referring now to FIGS. 11–17, a snowboard sling 100 according to an alternative embodiment of the present invention is shown. The three different perspectives of FIGS. 11–13 illustrate a snowboarder 101 utilizing a snowboard sling 100 to suspend a snowboard 102 from his shoulder and support the snowboard along his back without the use of his hands. FIGS. 15–17 illustrate a snowboarder 101 utilizing a snowboard sling 100 to suspend a snowboard 102 from his shoulder along one side of his body.

Figure 18:
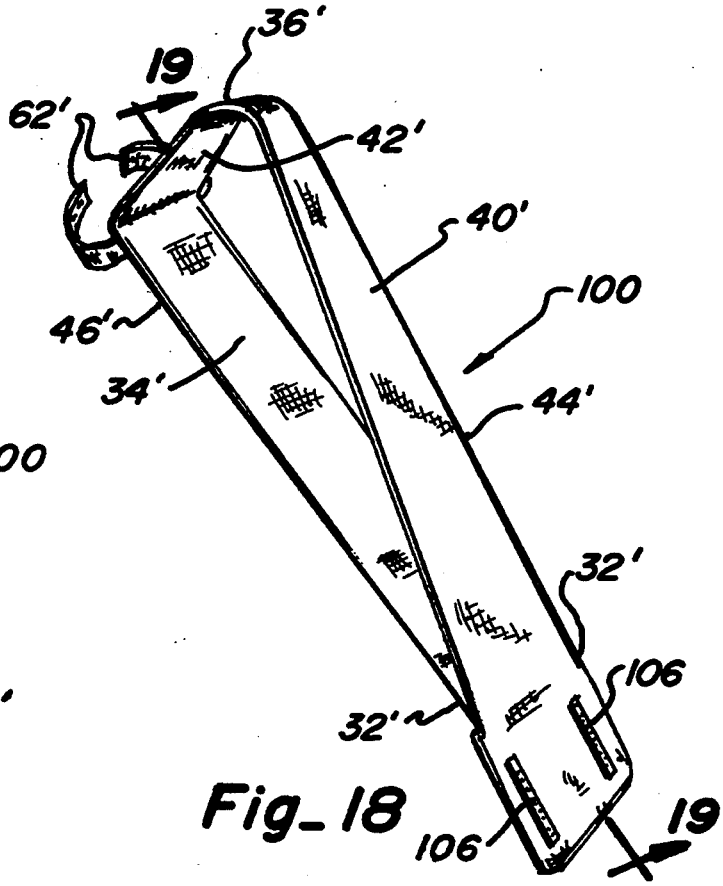
FIG. 18 is a perspective view of the snowboard sling embodying the present invention.

The snowboard sling 100 is substantially similar to the ski sling 20, and the same reference numerals will be used with a prime (') mark to describe equivalent parts between the two slings 20 and 100. Thus, like the ski sling 20, the snowboard sling 100 comprises a single fabric strap having first end 28' which overlaps a second end 30' to form a generally toroidal closed loop 34', as shown in FIGS. 18 and 19. Additionally, the first, second and third portions of the strap 48', 50' and 52', respectively, are similarly attached at their side edges 32' to form the outer and inner pockets 54' and 56'. The outer pocket 54' has an orifice of sufficient size to receive either a heel end or a toe end of the snowboard 102. Similarly, the stabilizing elongated tie strap 62' has sufficient length to surround the width of the snowboard 102 at a point above a pair of snowboard bindings 104 and secure the snowboard to the exterior surface of the rear side 46' of the closed loop 34'.

A number of minor differences between the ski sling 20 and the snowboard sling 100 are necessitated due to the differences between a pair of skis 22 and a snowboard 102. Since both snowboard bindings 104 are on a top surface of the snowboard 102, a substantially flat base of the snowboard is maintained against the exterior surface 40' of the rear side 46' of the closed loop 34'. Thus, the rear side 46' contains no elongated opening or aperture such as the opening 72 found on the ski sling 20. Additionally, since poles are not typically used with snowboards 102, the snowboard sling 100 also lacks the fabric loops 76 and the ski pole strap 82 found on the ski sling 20. Furthermore, the shape of the snowboard 102 requires the snowboard sling 100 to have a greater width than the ski sling 20 and a correspondingly longer tie strap 62'. The width of the front side 44' of the snowboard sling 100 is tapered along its length to provide a relatively narrow top end 36' which will fit more comfortably on a snowboarder's shoulder. However, other than the minor differences noted above, the construction and operation of the two slings 20 and 100 are substantially identical to one another.

The attachment of the tie strap 62' at a point above the snowboard bindings 104 positions a center of gravity of the snowboard 102, which is typically located between the two bindings 104, between the tie strap 62' and the outer pocket 54'. In this manner, the center of gravity of the snowboard is always at a level below the level of the snowboarder's shoulder, as shown in FIGS. 11–17.

Due to the greater width of the snowboard 102 relative to the pair of skis 22, the center of gravity of the snowboard 102 is not suspended substantially directly below the snowboarder's shoulder when the top end 36' of the closed loop 34' is fit over the snowboarder's shoulder, as shown in FIGS. 15 and 16. Thus, the snowboarder 101 may need to support the snowboard 102 with a free hand as shown in FIG. 15. If the snowboarder 101 adjusts the orientation of the snowboard 102 as shown in FIG. 17, he will again have to support the snowboard with a free hand. However, if the snowboarder 101 wishes to carry the snowboard 102 in a hands-free manner, he may slip the closed loop 34' over his head so that the interior surface 42' of the front side 44' of the closed loop is draped across his chest, as shown in FIGS. 11–13. In this manner, the top end 36' of the closed loop 34' engages the snowboarder's shoulder, while the snowboard 102 is supported along the snowboarder's back. Should the snowboarder 101 wish to adjust the orientation of the snowboard 102, such as when climbing steep terrain, the closed loop 34' may be easily slid along the snowboarder's shoulder as shown in FIG. 14. Of course, in the orientation of FIG. 14, the snowboard 102 is no longer supported along the snowboarder's back and must therefore be supported by a free hand.

When the snowboard sling 100 is not being used to carry a snowboard 102, a majority of the closed loop 34' can be folded up and stored within the outer pocket 54', as shown in FIGS. 20 and 21. Although not shown in the drawings, a hook and loop fastener may be used to seal the inner pocket 56' and an opening may be formed on the front side 44' of the closed loop 34' to allow access to the inner pocket 56' when the snowboard sling 100 is in the stored position shown in FIGS. 20 and 21. However, since the outer pocket 54' of the snowboard sling 100 is larger than the outer pocket of the ski sling 20, it is desirable to fold the outer pocket 54' over upon itself and thus further compact the snowboard sling 100 prior to storing it within a jacket pocket or the like. To facilitate this additional compaction step, hook and loop fasteners 106 are attached to the exterior surface 40' of the front side 44' along the opposite side edges 32' adjacent the bottom end 38', as shown in FIGS. 12, 16, 18 and 20. Once the majority of the closed loop 34' is stored within the outer pocket 54' as shown in FIGS. 20 and 21, the outer pocket is simply folded over to connect the hook and loop fasteners 106 as shown in FIG. 22.

The all-fabric construction of the ski sling 20 and the snowboard sling 100 allows the slings to be compacted to a greater degree than prior art ski carriers which include bulky fasteners and adjustment means. Additionally, the fabric slings 20 and 100 contain no rigid components which could injure the skier 21 or snowboarder 101 during a fall. Furthermore, the fabric construction of the slings 20 and 100 allows for reduced manufacturing costs in relation to prior art ski carriers that utilize complex adjustment or attachment means.

Graphics or advertising information may be printed on the flat exterior surfaces 40 and 40' of the front sides 44 and 44' of the slings 20 and 100, respectively. Such printed matter will be effectively displayed when the slings 20 and 100 are suspended from the skier's shoulder, as shown in FIGS. 3, 12 and 16. Furthermore, printed material may also be placed on the flat exterior surface of the outer pockets 54 and 54' which remain visible when the slings 20 and 100 are in their stored configuration, as shown in FIGS. 9 and 22.

Presently preferred embodiments of the present invention and many of their improvements have been described with a degree of particularity. This description has been made by way of preferred example and is based on a present understanding of knowledge available regarding the invention. It should be understood, however, that the scope of the present invention is defined by following claims, and not necessarily by the detailed description of the preferred embodiment.

The invention claimed is:

1. A device for carrying elongated ski equipment by suspending the equipment from a person's shoulder, comprising:

an elongated flexible strap having a first end, a second end and opposing side edges extending between the first and second ends;

said first end attached to said strap adjacent to said second end to form a closed loop having an interior surface, an exterior surface, a top end, a bottom end, a front side and a rear side;

a pocket secured to and extending between the opposing side edges on the exterior surface of the rear side of the closed loop, said pocket including a closed bottom and an open top having an orifice at least as large as a width dimension of one end of the elongated ski equipment, said pocket adapted for receiving and holding the one end of the elongated ski equipment adjacent the bottom end of the closed loop; and an elongated tie strap fixed to the rear side of the closed loop and having a length sufficient to substantially surround the width dimension of the elongated ski equipment and secure the elongated ski equipment to the exterior surface of the rear side of the closed loop, said tie strap and said pocket being positioned to be on opposite sides of a center of gravity of the elongated ski equipment so that the center of gravity of the ski equipment is suspended at a point below the level of the person's shoulder when the interior surface of the front side of the closed loop is fitted about the person's shoulder.

2. A carrying device as defined in claim 1, wherein the elongated ski equipment comprises at least one ski, said ski having a substantially flat base, a top surface opposite the base, a binding attached to the top surface, and a substantially flat heel portion at the one end of the ski.

3. A carrying device as defined in claim 2, wherein the elongated ski equipment further comprises a pair of skis coupled to one another along their respective bases so that a top surface and a binding of a first ski faces the rear side of the closed loop when the heel portions of the pair of skis are received within the pocket.

4. A carrying device as defined in claim 3, wherein the center of gravity of the pair of skis is suspended substantially directly beneath the person's shoulder when the interior surface of the top end of the closed loop is fitted about the person's shoulder.

5. A carrying device as defined in claim 4, wherein the rear side of the closed loop includes an elongated opening that circumferentially surrounds the binding on the first ski and allows the top surface of the first ski to engage the exterior surface of the rear side of the closed loop.

6. A carrying device as defined in claim 2, further comprising a supporting member having at least one opening for receiving one end of an elongated ski pole, said supporting member fixed to the rear side of the closed loop adjacent the pocket.

7. A carrying device as defined in claim 6, further comprising a second tie strap fixed to the rear side of the closed loop and having a length sufficient to substantially surround both the width dimension of the elongated ski equipment and the elongated ski pole, said second tie strap and said supporting member being positioned on opposite sides of a center of gravity of the elongated ski pole to secure the elongated ski pole to the rear side of the closed loop.

8. A carrying device as defined in claim 7, wherein said supporting member further comprises at least one flexible loop attached to the exterior surface of the pocket.

9. A carrying device as defined in claim 2, wherein the closed loop is capable of being folded over upon itself and substantially retained within the pocket.

10. A carrying device as defined in claim 9, wherein the closed loop is formed from a waterproof fabric material.

11. A carrying device as defined in claim 9, further comprising a compartment for retaining accessory items other than the elongated ski equipment.

12. A carrying device as defined in claim 11, further comprising an opening on the front side of the closed loop, said opening providing access to the compartment when the closed loop is substantially retained within the pocket.

13. A carrying device as defined in claim 1, wherein the elongated ski equipment comprises a snowboard, said snowboard having a substantially flat base, a top surface opposite the base, two bindings attached to the top surface, and a substantially flat heel portion at the one end of the snowboard.

14. A carrying device as defined in claim 13, wherein the pocket and the elongated tie strap maintain the substantially flat base in contact with the exterior surface of the rear side of the closed loop so that the two bindings extend outwardly from the closed loop when the interior surface of the closed loop is fitted about the person's shoulder.

15. A carrying device as defined in claim 14, wherein the closed loop is capable of being folded over upon itself and substantially retained within the pocket.

16. A carrying device as defined in claim 14, wherein the closed loop is formed from a waterproof fabric material.

17. A carrying device for generally elongate ski equipment presenting a major axis extending between upper and lower ends thereof and having a center of gravity at a point therebetween and a minor axis defining a width thereof at a given point along said major axis, said device comprising:

a carrying strap forming a closed loop for circumscribing a shoulder of an individual, said carrying strap having substantially parallel and spaced apart interior and exterior surfaces, said interior surface thereof intended for adjoining said shoulder of said individual when carrying said ski equipment;

a pocket secured to said strap and peripherally disposed outwardly of said carrying strap exterior surface, said pocket being capable of substantially surrounding and retaining said width of said ski equipment at said lower end thereof; and an elongated stabilizing strap secured to said strap and peripherally disposed outwardly of said carrying strap exterior surface, said stabilizing strap being positioned at a distance from said pocket such that said stabilizing strap is disposed on an opposite side of said center of gravity than said pocket, said strap being capable of substantially surrounding and retaining said ski equipment at said width thereof.

18. The carrying device of claim 17, wherein said generally elongate ski equipment comprises at least one ski.

19. The carrying device of claim 18, wherein said carrying strap further comprises an aperture communicating between said interior and exterior surfaces thereof between said pocket and said elongated stabilizing strap.

20. The carrying device of claim 19, wherein said aperture circumferentially surrounds a binding of said ski.

21. The carrying device of claim 18, further comprising at least one supporting member for surrounding and retaining generally elongate auxiliary ski equipment adjacent one end thereof.

22. The carrying device of claim 21, wherein said supporting member substantially adjoins said pocket.

23. The carrying device of claim 21, wherein said supporting member comprises at least one supporting loop disposed outwardly of said carrying strap exterior surface.

24. The carrying device of claim 21, further comprising an additional elongated stabilizing strap positioned at a distance from said supporting member beyond a center of gravity of said auxiliary ski equipment, said additional stabilizing strap for substantially surrounding and retaining said auxiliary ski equipment at a position remote from said one end thereof.

25. The carrying device of claim 18, wherein said carrying strap is manufactured from a substantially flexible fabric material.

26. The carrying device of claim 25, wherein said fabric material comprises a waterproof material.

27. The carrying device of claim 18, wherein said carrying strap is capable of being folded over upon itself and substantially retained within said pocket.

28. The carrying device of claim 27, further comprising a compartment for securing items other than said generally elongate ski equipment.

29. The carrying device of claim 28, wherein said compartment is accessible to said individual when said carrying strap is substantially retained within said pocket.

30. The carrying device of claim 17, wherein said generally elongate ski equipment comprises a snowboard.

31. The carrying device of claim 30, wherein said carrying strap is manufactured from a substantially flexible fabric material.

32. The carrying device of claim 31, wherein said fabric material comprises a waterproof material.

33. The carrying device of claim 30, wherein said carrying strap is capable of being folded over upon itself and substantially retained within said pocket.

* * * * *